US006959705B2

(12) United States Patent
Briedis et al.

(10) Patent No.: US 6,959,705 B2
(45) Date of Patent: Nov. 1, 2005

(54) OVEN DOOR ASSEMBLY

(75) Inventors: Val Briedis, Cleveland, TN (US); Jeffrey Ware, Chattanooga, TN (US)

(73) Assignee: Maytag Corporation, Newton, IA (US)

( * ) Notice: Subject to any disclaimer, the term of this patent is extended or adjusted under 35 U.S.C. 154(b) by 1 day.

(21) Appl. No.: 10/419,728

(22) Filed: Apr. 22, 2003

(65) Prior Publication Data

US 2004/0211405 A1 Oct. 28, 2004

(51) Int. Cl.[7] ..... F24C 15/04
(52) U.S. Cl. ..... 126/193; 126/200; 126/190
(58) Field of Search ..... 126/190, 200, 126/193, 198, 194, 197, 201, 42, 19 R; 52/616, 304; 219/408

(56) References Cited

U.S. PATENT DOCUMENTS

| | | | | | |
|---|---|---|---|---|---|
| 2,580,957 | A | | 1/1952 | Reeves | |
| 2,612,154 | A | | 9/1952 | Mills | |
| 3,577,973 | A | | 5/1971 | Katona | |
| 3,855,994 | A | | 12/1974 | Evans et al. | |
| 3,877,460 | A | | 4/1975 | Lotz et al. | |
| 4,041,930 | A | | 8/1977 | Katona | |
| 4,043,091 | A | | 8/1977 | Katona | |
| 4,060,069 | A | | 11/1977 | Drouin | |
| 4,253,286 | A | | 3/1981 | Katona | |
| 4,519,377 | A | * | 5/1985 | Taylor | 126/533 |
| 4,606,324 | A | | 8/1986 | Katona | |
| 5,029,571 | A | | 7/1991 | Trosin | |
| 5,337,727 | A | | 8/1994 | Borens et al. | |
| 5,588,421 | A | * | 12/1996 | Busch et al. | 126/200 |
| 5,664,554 | A | * | 9/1997 | Martin | 126/201 |
| 5,799,647 | A | | 9/1998 | Mills | |
| 5,819,722 | A | | 10/1998 | Katz | |
| 5,881,710 | A | | 3/1999 | Davis et al. | |
| 2004/0011348 | A1 | * | 1/2004 | Bachinski et al. | 126/193 |

FOREIGN PATENT DOCUMENTS

| | | | | |
|---|---|---|---|---|
| FR | 2450422 | * | 10/1980 | 126/198 |

* cited by examiner

*Primary Examiner*—Alfred Basichas
(74) *Attorney, Agent, or Firm*—Diederiks & Whitelaw, PLC

(57) ABSTRACT

An oven door includes a transparent zone defined by a window pack and an additional piece of glass arranged in front of the window pack. Specifically, the additional piece of glass is mounted at an angle to the panes of the window pack, with the angled glass diverging farther from the window pack at an upper section than at a lower section. Through mounting the angled piece of glass in the door as set forth above, a chimney effect is established for heat conducted through the door such that an attainable temperature at a front surface of the door is significantly reduced.

16 Claims, 2 Drawing Sheets

OVEN DOOR ASSEMBLY

BACKGROUND OF THE INVENTION

1. Field of the Invention

The present invention pertains to the art of cooking appliances and, more particularly, to an oven door assembly including an angled glass pane for a cooking appliance.

2. Discussion of the Prior Art

Ovens and their general construction are well known. In general, an oven includes a cooking cavity having an opening which is selectively closed by a door assembly. Usually, ovens are of two general configurations, the ovens are either built-in units, i.e. into a cabinet or wall, or the oven is a free standing range including a cooktop. The doors furnished with ovens can be composed of multiple components which can include a sealing panel, thermal insulation, a window, an intermediate panel, an outer panel, handles, hinges and, in some instances, a decorative face covering made of metal, glass or the like.

One important concern in connection with constructing an oven door is the need to assure that a front or outer surface of the door is maintained at an acceptable level throughout a cooking operation as the front surface can be touched by a consumer. In an oven door which lacks a window or transparent zone used to visually inspect the contents of an oven cavity without opening the oven door, a significant amount of room exists for insulation material. Therefore, under these circumstances, the front surface can be readily prevented from excessively heating.

When a window is provided in the door, the available space for insulation is significantly reduced. Regardless, excessive heating of the front surface of the door must still be considered. In the prior art, this potential problem has been addressed in various ways, such as by providing for a force flow of cooling air through the door or reducing the radiation permeability of the window panes by coating the panes or forming them from thermochromatic materials. Unfortunately, the forced cooling air flow can simply be too costly or complicated to efficiently address this surface temperature concern, and employing either thermochrome or coated panes can negatively affect the visual quality of the window.

U.S. Pat. No. 5,337,727 addresses this problem by arranging one or more angled window panes between inner and outer parallel window panes in a common frame for an oven door. That is, the overall window arrangement must include an inner pane, an outer pane and at least one center pane, with the center pane(s) being at an acute angle to the inner and outer panes. With this construction, heat is conducted into upper or lower parts of the door by reflecting the heat back and forth between adjacent, relatively angled window panes. Therefore, this known prior art provides for the multiple reflections and creates radiation paths between each of the parallel inner and outer panes and the angled center pane(s). Unfortunately, this prior art arrangement is not considered to limit the temperature of the outer surface of an oven door in the most efficient and effective manner.

For at least these reasons, there exists a need in the art for a more effective and economical manner to assure that the front surface of an oven door which includes a window does not overheat during operation of the oven, particularly during high temperature operations such as self-cleaning cycles.

SUMMARY OF THE INVENTION

The present invention is directed to an oven door including a transparent zone defined by a window pack and, more particularly, to reducing the temperature on the front surface of the oven door by positioning an additional piece of glass between the window pack and the front surface. Specifically, the additional piece of glass is mounted at an angle to the panes of the window pack. In accordance with the most preferred form of the invention, the additional piece of glass is mounted to a body portion of the door through upper and lower brackets. In any case, through mounting the angled piece of glass in the door as set forth above, the attainable temperature at the front surface of the door is effectively reduced.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
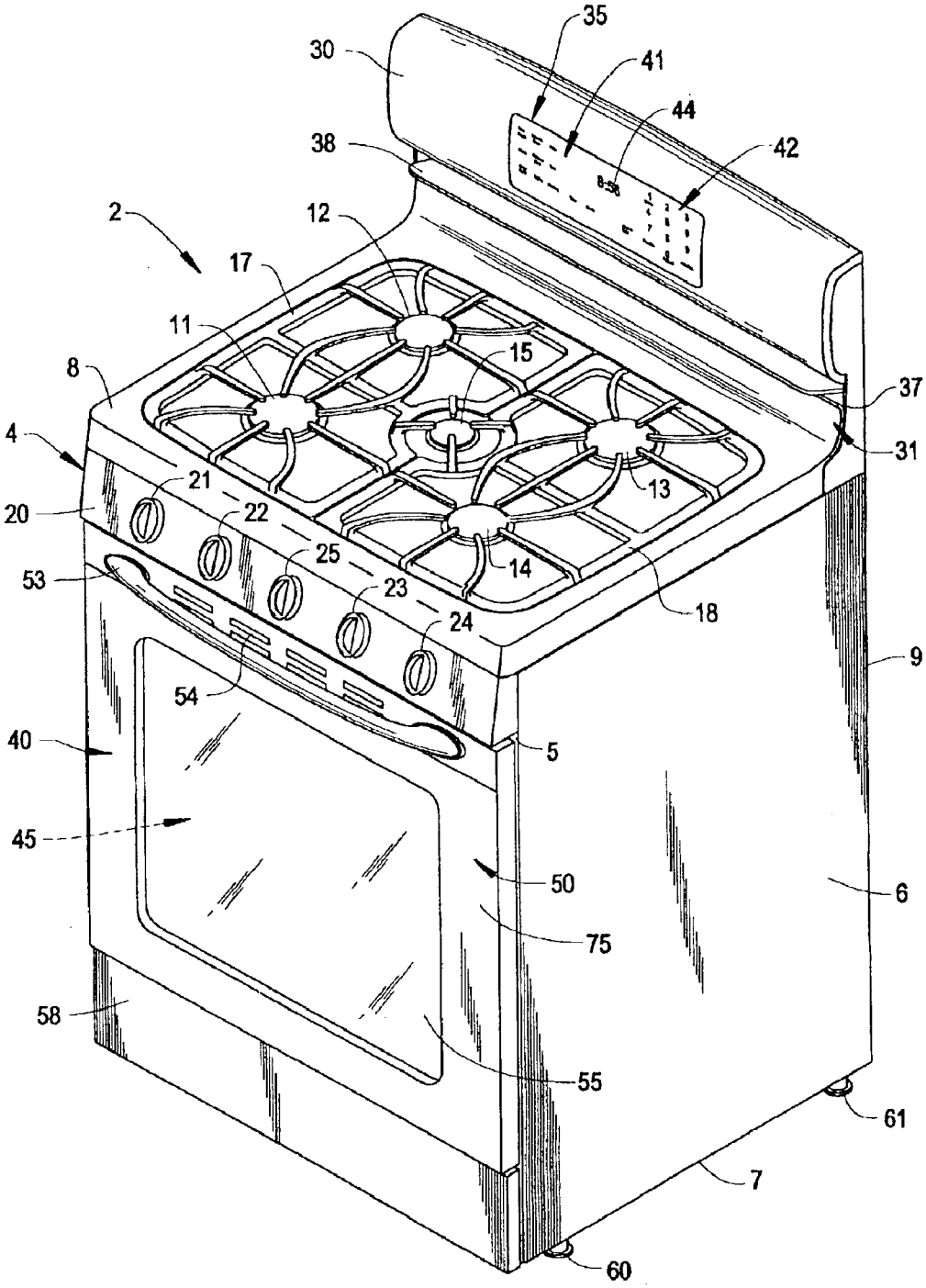
FIG. 1 is an upper right front perspective view of a cooking appliance incorporating an oven door assembly constructed in accordance with the present invention.

With initial reference to FIG. 1, the present invention is preferably incorporated into a cooking appliance generally indicated at 2. As shown, cooking appliance 2 takes the form of a free-standing gas range. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with five gas burner elements 11–15, i.e., four outer quadrant gas burner elements 11–14 and a central gas burner element 15, which are covered by left and right, mirror image burner grates 17 and 18.

In the embodiment illustrated, cabinet 4 further includes a front control surface 20. Preferably, control surface 20 supports a plurality of control knobs 21–25 for controlling the activation/de-activation of gas burners 11–15 respectively. Furthermore, cabinet 4 includes an upstanding control panel 30. In the embodiment shown, control panel 30 includes a central control and display unit, generally indicated at 35, mounted above an exhaust outlet opening 37 extending across upper rear portion 31 of cabinet 4. As shown, an exhaust deflector 38 is provided to redirect hot oven gases away from contact with central control and display unit 35 as well as surface portions of control panel 30. In any event, central control and display 35 is provided for use in controlling an oven 40 of range 2.

Although not fully detailed in this figure, control and display unit 35 includes a first control section 41 for selecting a desired cooking operation for oven 40. For instance, a user can select between keep warm, convection bake, bake, clean convection broil, broil, drying, and bread proofing operations. In connection with setting desired cooking parameters, control and display unit 35 also includes a second control section 42 which defines a numeric key pad. At this point, it should be realized that the arrangement and features associated with control panel 30 can vary without departing from the invention. For instance, in addition to other standard controls, such as timer and clock setting elements, control panel 30 can provide for other operations, such as a "cook and hold" feature wherein oven 40 operates to maintain food cooked therein warm following a cooking operation or a "favorite" selector which can be employed to readily establish a predetermined, preferred cooking sequence for oven 40. In any event, control and display unit 35 further includes a central display 44 for conveying information to and verifying input/operational parameters to a user.

In the preferred embodiment, oven 40 includes an oven cavity 45 which is larger than an oven cavity provided in a standard oven range. More specifically, wherein the volume of an oven cavity for a standard oven range would be in the order of 4.0 cubic feet, oven cavity 45 is approximately 5.2 cubic feet. In accordance with the present invention, oven cavity 45 is preferably formed of metal and coated with a heat resistant material, such as porcelain. In any case, oven 40 has associated therewith a door 50 which can be pivoted by means of a handle 53. Door 50 preferably includes a plurality of vents 54 arranged behind handle 53, and a window arrangement 55 for viewing the contents of oven cavity 45 when door 50 is closed. Arranged below door 50 and extending across cabinet 4 is a lower face panel 58.

In a manner known in the art, range 2 is adapted to be mounted upon a supporting surface, such as a kitchen floor or the like. More specifically, a plurality of leg members, two of which are indicated in FIG. 1 at 60 and 61, extend from bottom portion 7 at front and rear portions of cabinet 4, along side panel 6. Of course, corresponding leg members 60 and 61 are also provided on the opposing side of range 2. In any event, the various leg members 60 and 61 are preferably vertically adjustable to also act as levelers for range 2. Such type of leg leveler arrangements are widely known in the art of appliances, including both ranges and refrigerators such that the leveling function of leg members 60 and 61 does not form part of the present invention. Instead, the invention is actually directed to the construction of door 50 of appliance 2 as will be more fully discussed below.

Figure 2:
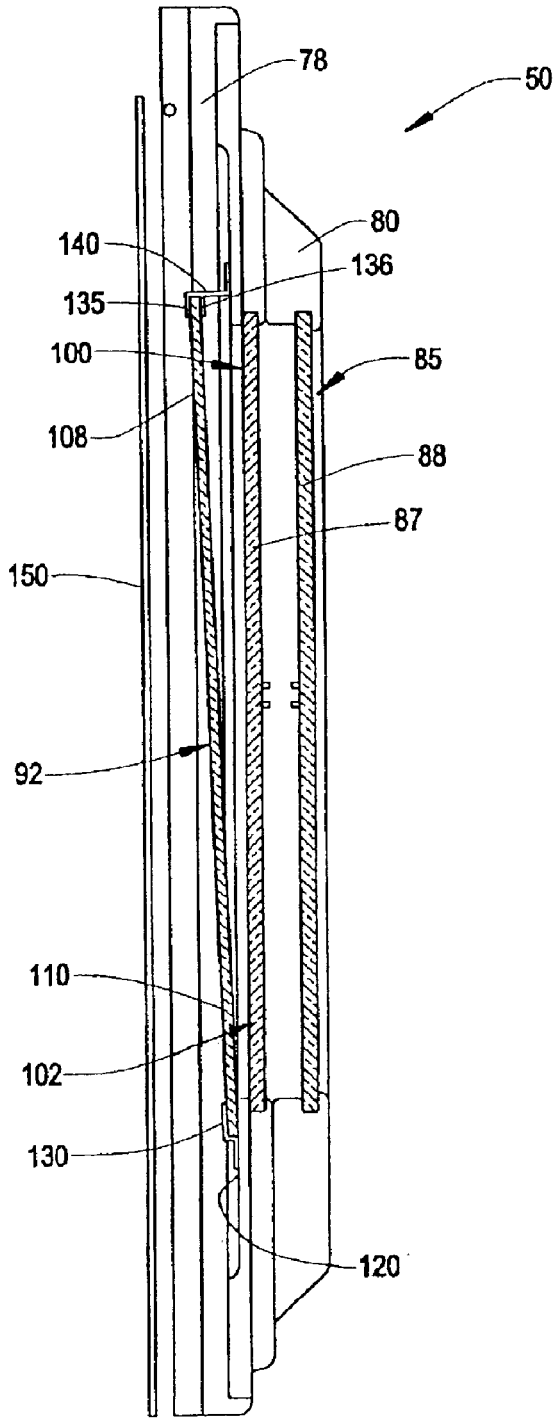
FIG. 2 is a partial exploded view of the oven door assembly of FIG. 1.

In the embodiment shown, door 50 includes an outer panel portion 75 (FIG. 1), as well as a central or intermediate body portion 78 and an inner panel portion 80 (FIG. 2). In the preferred embodiment shown, window arrangement 55 actually constitutes a plurality of transparent window panes. More specifically, door 50 includes a window pack 85 which is supported by inner panel portion 80. Window pack 85 includes first and second window panes 87 and 88 which are maintained in a spaced parallel relationship. Although not shown in detail, window pack 85 may include a peripheral frame which is pre-assembled with first and second window panes 87 and 88 in a manner disclosed in co-assigned U.S. patent application Ser. No. 10/045,081 entitled "Oven Door Assembly" which is incorporated herein by reference.

Of particular importance in accordance with the present invention is the inclusion of an intermediate transparent pane 92 within door 50. As clearly shown in FIG. 2, transparent pane 92 is angled with respect to the first and second window panes 87 and 88 of window pack 85. More specifically, window pack 85 includes an upper frontal portion 100 and a lower frontal portion 102. Correspondingly, angled transparent pane 92 includes an upper section 108 and a lower section 110. Transparent pane 92 is angle so as to be located closer to lower frontal portion 102 than to upper frontal portion 100 of window pack 85. In this manner, transparent pane 92 diverges from window pack 85 at an acute angle, preferably in the order of 1–10°. Therefore, the gap (not labeled) between angled transparent pane 92 and window pack 85 widens from lower section 110 to upper section 108.

Although transparent pane 92 can be fixed within door 50 in many different ways, in accordance with one preferred embodiment of the invention, lower section 110 is sandwiched between a wall 120 of intermediate body portion 78 and a first bracket 130. At the same time, upper section 108 is arranged between first and second legs 135 and 136 of a second bracket 140. In the most preferred embodiment of the invention, first and second window panes 87 and 88 are coated with tin oxide, while transparent pane 92 is not.

With this arrangement, heat being conducted from oven cavity 45 through door 50 reaches the gap between window pack 85 and transparent pane 92. This spacing or gap provides reflective qualities for the heat, while the widening of this gap provides a chimney effect for the heat which is actually directed upwards and exhausted out of vent openings 54. In this manner, outer panel portion 75 of door 50 remains quite cool and is not overheated, even when oven cavity 45 is undergoing a high temperature operation, such as a self-cleaning cycle. For instance, tests have shown that providing angled pane 92 reduces the outer oven door temperature in the order of 10–15° F. (approximately 5.6–8.3° C.) verses adding another parallel arranged piece of glass.

The overall window arrangement 55 may also include an outermost pane 150 as indicated in FIG. 2. However, it is really only important that door 50 includes window pack 85 in combination with angled transparent pane 92. Therefore, the number of panes, the particular mounting thereof, and the overall construction of door 50 can significantly vary without departing from the invention. For instance, door 50 can actually be formed in the manner set forth in the above-referenced U.S. patent application Ser. No. 10/045,081, with the inclusion of transparent pane 92. Therefore, it should be understood that, although the invention has been described with reference to a preferred embodiment, various changes can be made without departing from the spirit of the invention. Particularly, it should be recognized that the oven door construction of the invention can be employed in a wide range of cooking products, including wall ovens, slide-in ranges and the like. To this end, the invention is only intended to be limited by the scope of the following claims.

We claim:

1. A cooking appliance comprising: an oven cavity having an access opening; a control panel for selecting a desired cooking operation; at least one heating element for heating the oven cavity based on the desired cooking operation; and a door for selectively closing the access opening for the desired cooking operation, said door Including an inner panel portion, an outer panel portion, a window pack, and a transparent pane, said window pack having first and second, substantially parallel window panes arranged between the inner and outer panel portions, said transparent pane extending at an acute angle to the window pack, between the outer panel portion and the window pack, wherein the window pack includes an upper frontal portion and a lower frontal portion, said transparent pane diverging from the window pack upwardly such that the transparent pane is located farther from the upper frontal portion than the lower frontal portion.

2. The cooking appliance according to claim 1, wherein each of the first and second window panes are coated with tin oxide, while the transparent pane is not coated with tin oxide.

3. The cooking appliance according to claim 1, wherein the door further includes an intermediate body portion, said transparent pane being supported by the intermediate body portion.

4. The cooking appliance according to claim 3, further comprising: upper and lower brackets mounting the transparent pane to the intermediate body portion.

5. The cooking appliance according to claim 4, wherein the transparent pane is positioned between the lower bracket and the intermediate body portion.

6. The cooking appliance according to claim 4, wherein the upper bracket includes first and second spaced legs, said transparent pane being positioned between the first and second spaced legs.

7. The cooking appliance according to claim 4, wherein the upper and lower brackets are mounted distinct from the window pack.

8. The cooking appliance according to claim 1, wherein the outer panel portion is formed with a plurality of vent openings for exhausting hot air flowing between the window pack and the transparent pane.

9. A door for selectively closing an oven cavity access opening comprising: an inner panel portion; an outer panel portion; a window pack having first and second, substantially parallel window panes arranged between the inner and outer panel portions; and a transparent pane extending at an acute angle to the window pack, between the outer panel portion and the window pack, wherein the window pack includes an upper frontal portion and a lower frontal portion, said transparent pane diverging from the window pack upwardly such that the transparent pane is located farther from the upper frontal portion than the lower frontal portion.

10. The door according to claim 9, wherein each of the first and second window panes are coated with tin oxide, while the transparent pane is not coated with tin oxide.

11. The door according to claim 9, further comprising: an intermediate body portion, said transparent pane being supported by the intermediate body portion.

12. The door according to claim 11, further comprising: upper and lower brackets mounting the transparent pane to the intermediate body portion.

13. The door according to claim 12, wherein the transparent pane is positioned between the lower bracket and the intermediate body portion.

14. The door according to claim 12, wherein the upper bracket includes first and second spaced legs, said transparent pane being positioned between the first and second spaced legs.

15. The door according to claim 12, wherein the upper and lower brackets are mounted distinct from the window pack.

16. The door according to claim 9, wherein the outer panel portion is formed with a plurality of vent openings for exhausting hot air flowing between the window pack and the transparent pane.

* * * * *